US006351872B1

(12) United States Patent
McCormick

(10) Patent No.: US 6,351,872 B1
(45) Date of Patent: Mar. 5, 2002

(54) AGITATOR MOTOR PROJECTION SYSTEM FOR VACUUM CLEANER

(75) Inventor: Michael J. McCormick, Danville, KY (US)

(73) Assignee: Matsushita Electric Corporation of America, Secaucus, NJ (US)

( * ) Notice: Subject to any disclaimer, the term of this patent is extended or adjusted under 35 U.S.C. 154(b) by 0 days.

(21) Appl. No.: 09/575,945

(22) Filed: May 23, 2000

Related U.S. Application Data

(60) Provisional application No. 60/144,446, filed on Jul. 16, 1999.

(51) Int. Cl.[7] ..... A47L 9/28

(52) U.S. Cl. ..... 15/334; 15/339; 15/361; 15/377; 15/390

(58) Field of Search ..... 15/339, 361, 334, 15/377, 390, 332

(56) References Cited

U.S. PATENT DOCUMENTS

| | | | | | |
|---|---|---|---|---|---|
| 2,240,799 | A | * | 5/1941 | Riebel | 15/361 |
| 2,266,075 | A | * | 12/1941 | Replogle | 15/377 X |
| 2,534,479 | A | * | 12/1950 | Sellers | 15/390 X |
| 2,592,710 | A | * | 4/1952 | Kirby | 15/377 X |
| 2,625,239 | A | | 1/1953 | Senne | |
| 2,714,560 | A | * | 8/1955 | Becker | 15/333 |
| 2,715,452 | A | | 8/1955 | Kent | |
| 3,232,030 | A | | 2/1966 | Owenmark | |
| 3,510,904 | A | | 5/1970 | Lagerstrom | |
| 3,936,904 | A | | 2/1976 | Bashark | |
| 3,984,735 | A | | 10/1976 | Schwartz | |
| 4,034,415 | A | | 7/1977 | Suer | |
| 4,083,001 | A | | 4/1978 | Paice | |
| 4,195,254 | A | | 3/1980 | Gurwicz et al. | |
| 4,342,132 | A | | 8/1982 | Fromknecht | |
| 4,514,874 | A | | 5/1985 | Kurz | |
| 4,654,924 | A | | 4/1987 | Getz et al. | |
| 4,852,208 | A | | 8/1989 | Morishita et al. | |
| 4,977,639 | A | | 12/1990 | Takahashi et al. | |
| 5,105,502 | A | | 4/1992 | Takashima | |
| 5,243,732 | A | | 9/1993 | Koharagi et al. | |
| 5,331,715 | A | | 7/1994 | Johnson et al. | |
| 5,467,502 | A | | 11/1995 | Johnson et al. | |
| 5,551,119 | A | | 9/1996 | Worwag | |
| 5,839,160 | A | * | 11/1998 | Wang et al. | 15/390 |
| 6,256,832 | B1 | * | 7/2001 | Dyson | 15/339 X |

* cited by examiner

*Primary Examiner*—Chris K. Moore
(74) *Attorney, Agent, or Firm*—King and Schickli

(57) ABSTRACT

A vacuum cleaner includes a housing incorporating a handle assembly and a nozzle assembly, a suction fan and cooperating suction fan drive motor carried on the housing, a rotary agitator held in the nozzle assembly, an agitator drive motor carried on the housing and a motor control and protection circuit. The motor control and protection circuit includes a handle switch to de-energize the agitator motor when the handle is displaced to an upright storage position. The motor control and protection circuit may also include an above-floor switch and cooperating activation to de-energize the agitator drive motor when the nozzle assembly is displaced above the floor for bare floor cleaning. Additionally, the motor control and protection circuit may include a hose switch and activator, a selection switch and activator, a circuit breaker and a temperature sensor switch.

19 Claims, 3 Drawing Sheets

22
24
20
10
32
34
44
42
18
45
28
14
70
30
33
16
36
63
38

AGITATOR MOTOR PROJECTION SYSTEM FOR VACUUM CLEANER

This application claims benefit of Prov. No. 60/144,446 filed Jul. 16, 1999.

TECHNICAL FIELD

The present invention relates generally to the vacuum cleaner art and, more particularly, to a motor protection system for a vacuum cleaner.

BACKGROUND OF THE INVENTION

A vacuum cleaner is an electro-mechanical appliance utilized to effect the dry removal of dust, dirt and other small debris from carpets, rugs, fabrics or other surfaces in both domestic and industrial environments. In order to achieve the desired dirt and dust removal, a rotary agitator is provided to beat dirt and dust from the nap of the carpet and a pressure drop or vacuum is used to force air entrained with this dirt and dust into the nozzle of the vacuum cleaner. The particulate-laden air is then drawn through a bag-like filter or a cyclonic separation chamber and filter combination which traps the dirt and dust, while the substantially clean air is exhausted by an electrically operated fan that is driven by an on board motor. It is this fan and motor arrangement that generates the drop in air pressure necessary to provide the desired cleaning action. Thus, the fan and motor arrangement is commonly known as the vacuum or suction generator.

Many advanced, high performance vacuum cleaners incorporate a dual motor system. Accordingly, a separate agitator drive motor is provided in addition to the motor of the suction generator. At various times, the operation of the rotary agitator is not desirable for the most efficient cleaning performance. For example, when using an above floor attachment, to clean e.g. beneath the cushions of a sofa, operation of the rotary agitator serves no useful function and, in fact, causes unnecessary wear of the operating mechanism and the underlying carpet. As another example, operation of a rotary agitator during bare floor cleaning may cause turbulence that tends to push dust and dirt ahead of the vacuum cleaner nozzle thereby interfering with efficient cleaning. As such, deactivation of the agitator is also desired during bare floor cleaning. Hence, the ability to selectively de-energize the agitator drive is a desirable feature.

In addition, the agitator motor must be protected from overheating and/or overloading under adverse operating conditions which may arise in order to extend the service life of the vacuum cleaner. For example, a sock or other object may lodge between the rotary agitator and the nozzle housing partially or fully binding the agitator. Such a situation may not be immediately apparent to the operator. Accordingly, a "smart" vacuum cleaner which automatically detects and compensates for such a condition would be of significant benefit.

SUMMARY OF THE INVENTION

In accordance with the purposes of the present invention is described herein, an improved upright vacuum cleaner is provided. That vacuum cleaner incorporates a housing including a handle assembly and nozzle assembly. A suction fan and cooperating suction fan drive motor are carried on the housing. A rotary agitator is held in the nozzle assembly and a separate agitator drive motor is carried on the housing and functions to drive the rotary agitator. In addition, a motor control and protection circuit is provided. That motor control and protection circuit is characterized by a handle switch with a handle actuator cooperating with the handle switch to energize the agitator motor when the handle is displaced to an upright storage position.

In accordance with a further aspect of the present invention, the motor control and protection circuit may also include an above-floor switch and an above-floor actuator cooperating with the above-floor switch to de-energize the agitator drive motor when the nozzle assembly is displaced a predetermined distance above the floor. This may occur when, for example, the vacuum cleaner is adjusted for bare floor cleaning or the handle is moved to the fully upright storage position.

The vacuum cleaner may also further include a hose switch and a hose actuator cooperating with the hose switch to de-energize the agitator drive motor when an end of the vacuum cleaner hose is released and manipulated such as necessary when using the separate cleaning utensils for above floor cleaning.

Still further, the motor control and protection circuit may include a selector switch and a selector actuator cooperating with the selector switch for selectively de-energizing the agitator drive motor independent of the suction fan drive motor. Preferably, that selector actuator is positioned on the nozzle assembly where it may be easily and conveniently manipulated by engagement with a foot or toe of the vacuum cleaner operator.

In accordance with yet another aspect of the present invention, the motor control and protection circuit may also include a circuit breaker adapted to interrupt the power to the agitator drive motor if the current drawn by that motor exceeds a predetermined first value. Such a situation may occur, for example, in the event the rotary agitator becomes jammed through engagement with the fringe of a rug or other object that wedges between the agitator and the nozzle assembly thereby preventing or restricting the rotation of the agitator.

Additionally, the motor control and protection circuit may include a temperature sensor switch to interrupt power to the agitator drive motor if the temperature of the agitator drive motor exceeds a predetermined second value. This may, for example, occur if the vacuum cleaner is being operated continuously at peak power in a harsh, dusty operating environment where the cooling air flow over the agitator drive motor becomes restricted.

Advantageously, the motor control and protection circuit of the present invention provides trouble free operation of the agitator drive motor in a vacuum cleaner incorporating separate suction fan and agitator drive motors. More specifically, the agitator drive motor is protected from overloading and overheating at all times under all operating conditions. Additionally, the most efficient performance of the vacuum cleaner is ensured as the agitator drive motor is de-energized when operation of the rotary agitator is not of benefit. Thus, for example, when the hose is disconnected at one end by the operator for purposes of above floor cleaning, the agitator drive motor is de-energized to save energy and wear and tear on both the vacuum cleaner and the floor surface being engaged by the rotary agitator. Similarly, de-energization takes place when the handle of the vacuum cleaner is placed in the upright storage position and the vacuum cleaner is not being manipulated to-and-fro to clean the floor. Similarly, the agitator drive motor is de-energized when the nozzle assembly is adjusted to a height for bare floor cleaning. By de-energizing the agitator drive motor in this mode, dust and debris are moved under the force of negative pressure from the floor through the nozzle assembly and hose toward the dust bag where they are collected without any interference from the rotary action of the agitator. Further, a convenient on-off switch is provided to allow the operator to individually select de-energization of the agitator drive motor under substantially any operating condition where that mode of operation is deemed desirable. Thus, the vacuum cleaner of the present invention provides unmatched versatility and allows use at maximum efficiency under substantially any foreseeable operating conditions.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing:

FIG. 4*a* shows the handle actuator when the handle is in the upright storage position and FIG. 4*b* shows the handle actuator when the handle is in a lowered, operative position.

Reference will now be made in detail to the present preferred embodiment of the invention, an example which is illustrated in the accompanying drawing.

DETAILED DESCRIPTION OF THE INVENTION

Figure 1:
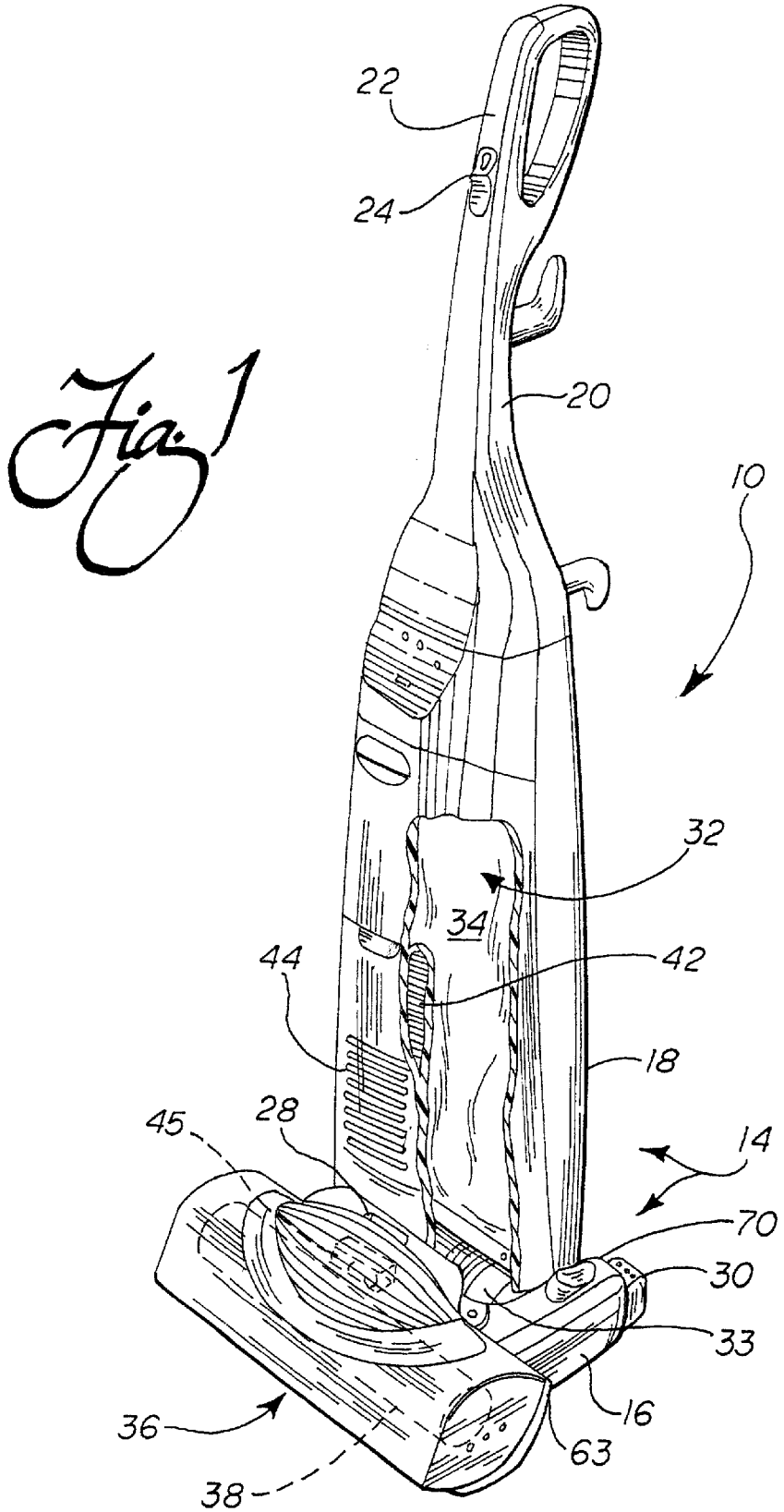
FIG. 1 is a perspective view of the vacuum cleaner of the present invention.

Reference is now made to FIG. 1 showing the vacuum cleaner 10 of the present invention. It should be appreciated that while an upright vacuum cleaner 10 is illustrated, canister vacuum cleaners incorporating a driven rotary agitator in what is referred to in the art as a "power nozzle" may also utilize and benefit from the novel motor control and protection circuit 12 best shown in detail in FIGS. 2 and 3 and described further below.

The overall basic design of an upright vacuum cleaner 10 is generally well known in the art. In the typical arrangement, the upright vacuum cleaner 10 includes a housing 14 that comprises the nozzle assembly 16 and the canister assembly 18. The canister assembly 18 further includes the handle 20 and the hand grip 22. The hand grip 22 carries a control switch 24 for turning the vacuum cleaner 10 on and off. Of course, electrical power is supplied to the vacuum cleaner 10 from a standard electrical wall outlet through a cord (not shown).

At the lower portion of the canister assembly 18, rear wheels (not shown) are provided to support the weight of the vacuum cleaner 10. A second set of wheels (not shown) allow the operator to raise and lower the nozzle assembly 16 through selective manipulation of the height adjustment switch 28. Such a height adjustment mechanism is shown and described in detail in U.S. Pat. No. 5,467,502 to Johnson et al. and owned by the assignee of the present invention. The full disclosure in this patent is incorporated herein by reference.

To allow for convenient storage of the vacuum cleaner 10, a foot latch 30 functions to lock the canister assembly 18 in an upright position, as shown in FIG. 1. When the foot latch 30 is released, the canister assembly 18 may be pivoted relative to the nozzle assembly 16 as the vacuum cleaner 10 is manipulated to clean the floor.

The canister assembly 18 also carries an internal chamber 32 that houses a suction generator 33 (i.e. a state of the art fan and motor combination) and a dust bag 34 for removing dirt or dust entrained in the air stream as it passes from the nozzle assembly 16 to the suction generator. The canister assembly 18 may also carry a final filtration cartridge 42 to trap small particulates and prevent their reintroduction into the environment through the exhaust port 44.

The nozzle assembly 16 includes a nozzle and agitator cavity 36 that houses a rotating agitator brush 38. The agitator brush 38 shown is rotatably driven by a motor 40 and cooperating gear drive (not shown) housed within the agitator (see FIG. 2). Such an arrangement is described in greater detail in copending U.S. provisional patent application Ser. No. 60/144,565 filed Jul. 16, 1999, the full disclosure of which is incorporated herein by reference.

In the illustrated vacuum cleaner 10, the scrubbing action of the rotary agitator brush 38 and the negative air pressure created by the suction generator 33 cooperate to brush and beat dirt and dust from the nap of the carpet being cleaned and then draw the dirt and dust laden air from the agitator cavity 36 to the dust bag 34. Specifically, the dirt and dust laden air passes serially through a suction inlet and hose (not shown) and/or an integrally molded conduit in the nozzle assembly 16 and/or canister assembly 18 as is known in the art. Next, it is delivered into the chamber 32 and passes through the porous walls of the dust bag 34. The bag 34 serves to trap the suspended dirt, dust and other particles inside while allowing the now clean air to pass freely through the wall thereof and then through the suction generator 33, final filtration cartridge 42 and ultimately to the environment through the exhaust port 44.

Figure 3:
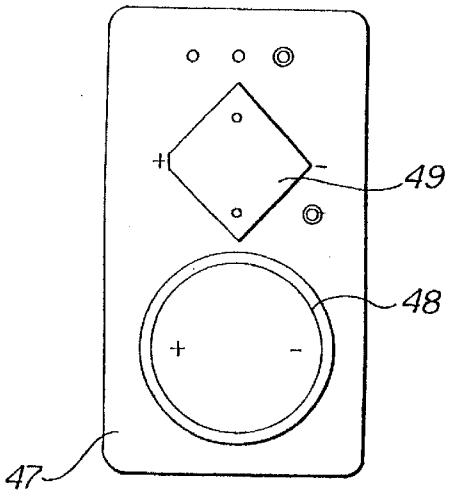
FIG. 3 is schematical showing of the printed circuit board utilized in the motor control and protection circuit of FIG. 2.
Figure 2:
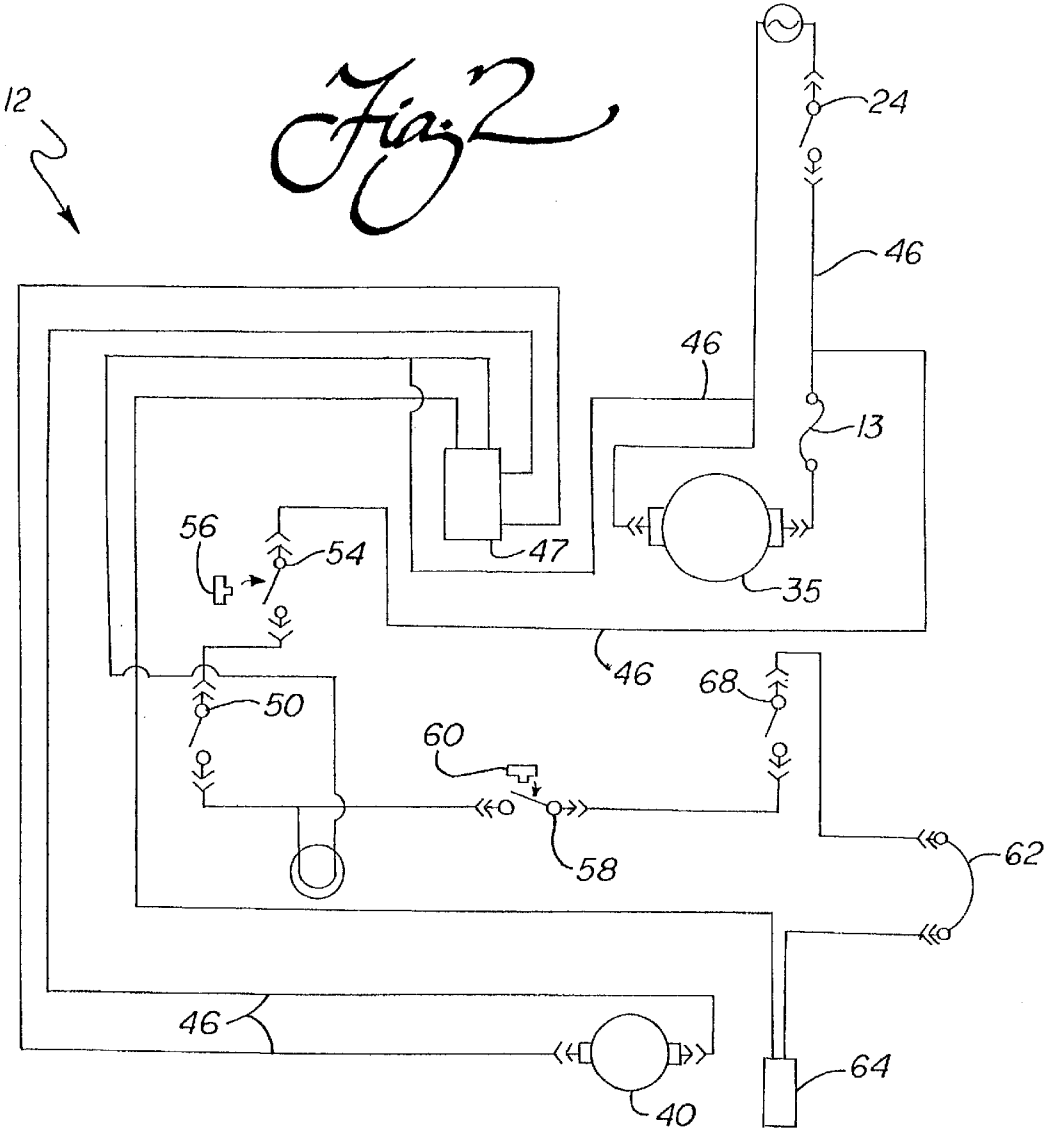
FIG. 2 is a schematical wiring diagram showing the motor control and protection circuit incorporated into the vacuum cleaner of the present invention.

Reference is now made to FIGS. 2 and 3 which schematically illustrate the motor control and protection circuit 12 incorporated into the vacuum cleaner 10 of the present invention. The motor control and protection circuit 12 includes a series of electrical lines 46 that deliver power through fuse 13 to the suction fan drive motor 35 of the suction generator 33 and the agitator drive motor 40 and the headlight 45. A printed circuit board 47 (see FIG. 3) includes a 250 V 330 $\mu$F, 105° C. capacitor 48 and a 600 V, 4 Å bridge rectifier 49 for converting AC power from an electrical outlet to DC power for the agitator drive motor 40. The primary on-off switch 24 controls the overall power to the system from the electrical outlet. Various switches including handle switch 50, hose switch 54, above-floor switch 58, temperature sensor switch 64, selector switch 68 and circuit breaker 62 allow interruption of the circuit leading to the agitator drive motor 40 in a manner described in greater detail below.

Figures 4A, 4B:
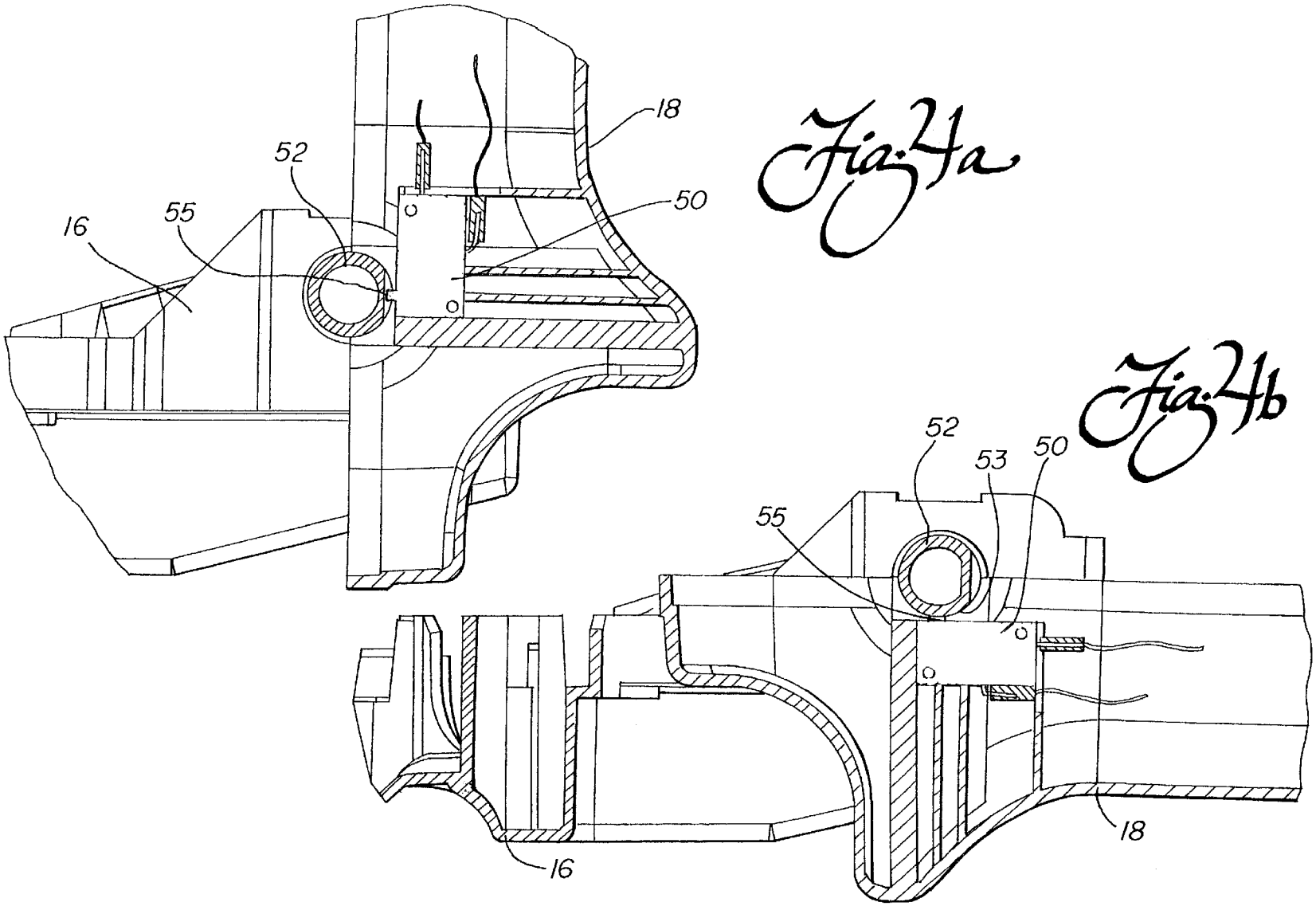
FIGS. 4*a* and 4*b* are detailed schematical views of the handle switch and handle actuator which form a part of the motor control and protection circuit.

As best illustrated in FIGS. 2, 4*a* and 4*b*, the motor control and protection circuit 12 of the present invention includes a handle switch 50 which is mounted to either the nozzle assembly 16 or canister assembly 18 and a cooperating handle actuator 52 mounted to the other of the nozzle assembly and canister assembly. In the embodiment illustrated, the switch 50 is mounted in the canister assembly 18 and the trigger 55 thereof rides over the cam surface 53 of the handle actuator 52 as the handle 20 is pivoted about the actuator relative to the nozzle assembly 16. Thus, when the handle 20 is lowered into an operative position, the semicircular cam 53 of the handle actuator 52 engages the trigger 55 of the normally open switch 50 thereby maintaining the circuit closed for the energization and powering of the agitator drive motor 40. When the handle 20 is positioned in the upright storage position shown in FIG. 1, the trigger 55 disengages from the semicircular cam 53 thereby breaking the circuit leading to the agitator drive motor 40. Accordingly, the motor 40 is de-energized and operation of the rotary agitator 38 is halted when the handle 20 is moved and locked into the storage position. Such handle movement is completed when the operator is finished vacuuming or is going to complete above floor cleaning by using an attachment. As such, the motor control and protection circuit 12 effectively senses the operator's intent through the handle switch 50 and de-energizes the agitator drive motor 40 since its operation under these conditions is of no benefit. This not only reduces power consumption but saves unnecessary wear and tear on the agitator drive motor 40, the agitator brush 38 and the underlying floor or carpet.

In addition, the motor control and protection circuit 12 also includes a hose switch 54 and a hose actuator 56 of a type such as described in detail in U.S. Pat. No. 5,331,715 issued to Johnson et al. and assigned to the assignee of the present invention. The full disclosure in the U.S. Pat. No. 5,331,715 patent is incorporated herein by reference. The switch 54 may comprise a normally open microswitch and the actuator 56 may comprise the hose cuff that plugs into the nozzle assembly 16. Thus, when the hose cuff 56 is attached to the nozzle assembly, the normally open microswitch 54 is held in the closed position thereby allowing power to pass to the agitator motor 40. In contrast, when the hose cuff 56 is removed from the nozzle assembly 16 for connection to a cleaning attachment, the microswitch 54 opens, thereby de-energizing the agitator motor 40. Thus, the intent of the operator to complete cleaning via one of the attachments is promptly sensed and the agitator drive motor 40 is de-energized as under such conditions its operation is of no benefit.

The motor control and protection circuit 12 also includes an above floor switch 58 responsive to an above floor actuator 60 such as a wheeled plunger which may be of the type shown in U.S. Pat. No. 5,105,502 to Takashima. The full disclosure of this patent is incorporated herein by reference. When the nozzle assembly 16 is raised by means of the height adjustment switch 28 for above floor cleaning, the above floor actuator 60 disengages from the normally open above floor switch 58 thereby causing the agitator motor 40 to de-energize. This is a benefit during bare floor cleaning as air flow backwash from a rotating agitator can interfere with the efficient and effective cleaning of a bare floor.

The motor control and protection circuit 12 still further includes a circuit breaker 62. Circuit breaker 62 interrupts power to the agitator drive motor 40 if the current drawn by that motor exceeds a predetermined first value. Thus, motor overload is prevented. Such a situation may occur, for example, when the rotary agitator brush 38 becomes bound from the fringe of a throw rug or the wedging of an object such as a sock between the nozzle wall and the rotary agitator brush. A reset 63 for the circuit breaker 62 may be mounted in a recess on the side of nozzle assembly 16 where it may be easily reached, yet is protected from inadvertent contact (see also FIG. 1).

Still further, the motor control and protection circuit 12 may also include a temperature sensor switch 64 such a thermistor to interrupt power to the agitator drive motor 40 if the temperature of the agitator drive motor exceeds a predetermined second value. Where the agitator drive motor 40 is mounted in the rotary agitator brush 38, the temperature sensor switch 64 is mounted in an air passageway (not shown) in the nozzle assembly 16 between the agitator motor 40 and the suction inlet leading to the hose 42 and the suction fan drive motor 35. Thus, after the cooling air is warmed through heat exchange by passing over the agitator drive motor 40 it flows over the temperature sensor 64. If the temperature of the now warmed air exceeds a certain temperature value, the temperature sensor switch 64 functions to interrupt the power to the agitator drive motor 40, thereby preventing the drive motor from overheating.

Still further, the motor control and protection circuit 12 may include a selector switch 68 such as a rocker switch and an actuator 70 therefore. The selector actuator 70 may be mounted on top of the nozzle assembly 16 as shown in FIG. 1. There it may be engaged with the toe or foot of the operator to conveniently energize and de-energize the agitator motor 40 separate and apart from the suction fan motor 35. Thus, if a situation arises where the operator wishes to de-energize the agitator motor 40 and this has not already occurred as result of the operation of the previously described switches 50, 54, 58, 64 and circuit breaker 62, the operator may conveniently do so.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An upright vacuum cleaner, comprising:

a housing including a handle assembly and a nozzle assembly;

a suction fan and cooperating suction fan drive motor carried on said housing;

a rotary agitator held in said nozzle assembly;

an agitator drive motor carried on said housing; and a motor control and protection circuit, said motor control and protection circuit being characterized by a handle switch and a handle actuator cooperating with said handle switch to de-energize said agitator motor when said handle is displaced to an upright storage position.

2. The vacuum cleaner of claim 1, wherein said motor control and protection circuit further includes an above-floor switch and an above-floor actuator cooperating with said above-floor switch to de-energize said agitator drive motor when said nozzle assembly is displaced a predetermined distance above the floor for bare floor cleaning.

3. The vacuum cleaner of claim 2, wherein said vacuum cleaner further includes a hose and said motor control and protection circuit further includes a hose switch and a hose actuator cooperating with said hose switch to de-energize said agitator drive motor when an end of said hose is released and manipulated for cleaning.

4. The vacuum cleaner of claim 3, wherein said motor control and protection circuit further includes a selector switch and a selector actuator cooperating with said selector switch for selectively de-energizing said agitator drive motor independent of said suction fan drive motor.

5. The vacuum cleaner of claim 4, wherein said motor control and protection circuit further includes a circuit breaker to interrupt power to said agitator drive motor if current drawn thereby exceeds a predetermined first value.

6. The vacuum cleaner of claim 5, wherein said motor control and protection circuit further includes a temperature sensor switch to interrupt power to said agitator drive motor if temperature of said agitator drive motor exceeds a predetermined second value.

7. The vacuum cleaner of claim 4, wherein said motor control and protection circuit further includes a temperature sensor switch to interrupt power to said agitator drive motor if temperature of said agitator drive motor exceeds a predetermined second value.

8. The vacuum cleaner of claim 3, wherein said motor control and protection circuit further includes a circuit breaker to interrupt power to said agitator drive motor if current drawn thereby exceeds a predetermined first value.

9. The vacuum cleaner of claim 3, wherein said motor control and protection circuit further includes a temperature sensor switch to interrupt power to said agitator drive motor if temperature of said agitator drive motor exceeds a predetermined second value.

10. The vacuum cleaner of claim 2, wherein said motor control and protection circuit further includes a selector switch and a selector actuator cooperating with said selector switch for selectively de-energizing said agitator drive motor independent of said suction fan drive motor.

11. The vacuum cleaner of claim 2, wherein said motor control and protection circuit further includes a circuit breaker to interrupt power to said agitator drive motor if current drawn thereby exceeds a predetermined first value.

12. The vacuum cleaner of claim 2, wherein said motor control and protection circuit further includes a temperature sensor switch to interrupt power to said agitator drive motor if temperature of said agitator drive motor exceeds a predetermined second value.

13. The vacuum cleaner of claim 1, wherein said vacuum cleaner further includes a hose and said motor control and protection circuit further includes a hose switch and a hose actuator cooperating with said hose switch to de-energize said agitator drive motor when an end of said hose is released and manipulated for cleaning.

14. The vacuum cleaner of claim 1, wherein said motor control and protection circuit further includes a selector switch and a selector actuator cooperating with said selector switch for selectively de-energizing said agitator drive motor independent of said suction fan drive motor.

15. The vacuum cleaner of claim 1, wherein said motor control and protection circuit further includes a circuit breaker to interrupt power to said agitator drive motor if current drawn thereby exceeds a predetermined first value.

16. The vacuum cleaner of claim 1, wherein said motor control and protection circuit further includes a temperature sensor switch to interrupt power to said agitator drive motor if temperature of said agitator drive motor exceeds a predetermined second value.

17. The vacuum cleaner of claim 1, wherein said handle switch is a normally open microswitch mounted in said handle for rotation about said handle actuator as said handle is displaced to and from said upright storage position.

18. The vacuum cleaner of claim 17, wherein said handle actuator includes a cam surface defining a semicircular arc about a pivotal axis of said handle, said semicircular arc of said cam surface engaging a trigger of said microswitch when said handle is in other than said upright storage position.

19. The vacuum cleaner of claim 18, wherein said cam surface includes a non semicircular arc portion where said trigger of said microswitch disengages from said cam surface when said handle is in said upright storage position thereby de-energizing said agitator drive motor.

* * * * *

UNITED STATES PATENT AND TRADEMARK OFFICE

CERTIFICATE OF CORRECTION

PATENT NO. : 6,351,872 B1
DATED : March 5, 2002
INVENTOR(S) : Michael J. McCormick It is certified that error appears in the above-identified patent and that said Letters Patent is hereby corrected as shown below:

Title page,
Item [54], the title of the invention should be corrected to read as follows:
-- AGITATOR MOTOR PROTECTION SYSTEM FOR VACUUM CLEANER --

Signed and Sealed this

Eleventh Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,351,872 B1
APPLICATION NO. : 09/575945
DATED : March 5, 2002
INVENTOR(S) : Michael J. McCormick et al.

It is certified that error appears in the above-identified patent and that said Letters Patent is hereby corrected as shown below:

On the title page
Item [75], please add the following inventor: Timothy M. Scott, Lancaster, KY (US).

Signed and Sealed this
Twenty-eighth Day of June, 2016

Michelle K. Lee

Michelle K. Lee
*Director of the United States Patent and Trademark Office*